US006246384B1

(12) United States Patent
Sano

(10) Patent No.: US 6,246,384 B1
(45) Date of Patent: Jun. 12, 2001

(54) ELECTROLUMINESCENCE DISPLAY APPARATUS

(75) Inventor: Keiichi Sano, Gifu (JP)

(73) Assignee: Sanyo Electric Co., Ltd. (JP)

( * ) Notice: Subject to any disclaimer, the term of this patent is extended or adjusted under 35 U.S.C. 154(b) by 0 days.

(21) Appl. No.: 09/274,513

(22) Filed: Mar. 23, 1999

(30) Foreign Application Priority Data

Mar. 26, 1998 (JP) ..... 10-078770

(51) Int. Cl.[7] ..... G09G 3/10

(52) U.S. Cl. ..... 345/76; 345/77; 345/80; 345/90; 345/92; 345/93; 345/204; 345/205; 345/214; 315/169.3

(58) Field of Search ..... 345/76, 77, 80, 345/90, 92, 93, 204, 205, 214; 315/169.3

(56) References Cited

U.S. PATENT DOCUMENTS 5,576,726 * 11/1996 Rhyne et al. ..... 345/76
5,714,968 * 2/1998 Ikeda ..... 345/77
5,990,629 * 11/1999 Yamada et al. ..... 315/169.3

* cited by examiner

*Primary Examiner*—Bipin Shalwala
*Assistant Examiner*—Vincent E. Kovalick
(74) *Attorney, Agent, or Firm*—Cantor Colburn LLP

(57) ABSTRACT

An EL device (40) formed from an anode, a cathode, and a light emitting device layer sandwiched between both electrodes, a first TFT (10) of which a drain electrode (12) is connected to a drain signal line D and a gate electrode (11) is connected to a gate signal line G, and a second TFT (20) of which a source electrode is connected to a third TFT (52), a drain electrode is connected to a driving power supply (50-1), and a gate electrode is connected to the source electrode of the first TFT (10), are provided. A third and a fourth TFT (52, 56), which are connected between the second TFT (20) and the EL device (40), for switching in accordance with an external signal of 10 kHz repeatedly charges and discharges a charging capacitor (50-1) between the third and fourth TFTs, the discharge of which supplies a current to the EL device (40). The charging capacitor (50-1) is charged up to a gate voltage $V_{G2}$ of the second TFT (20) and a current in accordance with the voltage charged to this charging capacitor (50-1) is supplied to the organic EL device (40) so that the light emission at the organic EL devices can be kept uniform.

8 Claims, 5 Drawing Sheets

ELECTROLUMINESCENCE DISPLAY APPARATUS

BACKGROUND OF THE INVENTION

1. Field of the Invention

The present invention relates to a drive circuit for an electroluminescence (hereinafter referred to as EL) display apparatus comprising an electroluminescence device and thin-film transistors (hereinafter referred to as TFT).

2. Description of the Prior Art

In recent years, EL display apparatuses using EL devices have gained attention as display apparatuses to replace CRTs and LCDS.

Furthermore, display apparatuses using TFTs as the switching devices for driving the EL device are being researched and developed.

FIG. 1 shows a circuit diagram of an organic EL display apparatus of the prior art.

According to the same diagram, a display pixel 1 of the organic EL display apparatus of the prior art comprises a first TFT 100, a second TFT 200, a holding capacitor 300, and an organic EL device 400.

A gate signal line G, which supplies a gate signal, and a drain signal line D, which supplies a drain signal, cross, and in the vicinity of the intersection of both signal lines G and D there are provided the organic EL device 400 and the TFTs 100, 200 for driving the organic EL device 400.

First, the first TFT 100 comprises a gate electrode 110, which is connected to the gate signal line G and supplied with the gate signal, a drain electrode 120, which is connected to the drain signal line D and supplied with the drain signal, and a source electrode 130, which is connected to a gate electrode 210 of the second TFT 200 and to the holding capacitor 300.

Next, the second TFT 200 comprises the gate electrode 210, which is connected to the source electrode 130 of the first TFT 100, a source electrode 220, which is connected to an anode 410 of the organic EL device 400, and a drain electrode 230, which is connected to a driving power supply 500 for supplying power to the organic EL device 400 so as to drive the organic EL device 400.

Furthermore, the organic EL device 400 comprises the anode 410, which is connected to the source electrode 220 of the second TFT 200, a cathode 420, which is connected to a common power supply terminal 600, and a light emitting device layer 430, which is sandwiched between the anode 410 and the cathode 420.

When the gate signal from the gate signal line G is supplied to the gate electrode 110 of the first TFT 100, the first TFT 100 turns on and the drain signal that was supplied from the drain signal line D is applied to the gate electrode 210 of the second TFT 200 and to the holding capacitor 300. As a result, the second TFT 200 turns on and a current flows, corresponding to the gate voltage of the second TFT 200, from the driving power supply 500 to the organic EL device 400 so that the light emitting device layer 430 of the organic EL device 400 emits light.

The organic EL device 400 is deposited in a sequence of the anode 410 formed from a transparent electrode, such as indium tin oxide (ITO), a first hole transport layer formed from 4,4'-bis(3-methylphenylphenylamino)biphenyl (MTDATA), a second hole transport layer formed from 4,4',4"-tris(3-methylphenylphenylamino)triphenylanine (TPD), a light emitting layer formed from 10-benzo[h]

beryllium-benzoquinolinol complex ($Bebq_2$) including a Quinacridone derivative, the light emitting device layer 430 formed from various electron transport layers formed from $Bebq_2$, and the cathode 420 formed from a magnesium-indium alloy.

In the organic EL device, holes injected from the anode and electrons injected from the cathode are recombined within the light emitting layer so as to excite the organic molecules forming the light emitting layer and generate an exciton. In the process where the exciton deactivates, light is released from the light emitting layer. This release of light to the outside from the transparent anode through the transparent insulating substrate results in light being emitted.

On the other hand, it is necessary for the EL device in each display pixel to emit the same quantity of light so that a uniform and stable display is obtained at the surface of the EL display apparatus. However, since the characteristic of each second TFT 200 that is provided in each display pixel is not uniform, the currents supplied to the EL devices by the drive circuit for the EL display apparatus in the prior art cannot be kept uniform, thus resulting in a problem where the non-uniform currents appear as an uneven display among the display pixels.

Namely, the size of each second TFT varies, due to deviations in mask patterns during the manufacture of the TFTs and so forth, so that the current flowing to each drain varies even though the same gate voltage is applied to each second TFT. Therefore, the current supplied to the EL device differs with each display pixel and appears as an uneven display.

SUMMARY OF THE INVENTION

In view of the shortcomings of the above-mentioned prior art, it is therefore an object of the present invention to provide an EL display apparatus, in particular a drive circuit for the EL device, designed to improve the uniformity of light emission among display pixels and to easily enable the current supply to the EL device to be controlled.

The electroluminescence display apparatus of the present invention for performing display operations by an electroluminescence device, which comprises an anode and a cathode, emitting light, comprises: a first thin-film transistor, of which a source electrode is connected to a holding capacitor, a drain electrode is connected to a drain signal line, and a gate electrode is connected to a gate signal line; a second thin-film transistor, of which the drain electrode is connected to a driving power supply of the above-mentioned electroluminescence device, and the gate electrode is connected to the source electrode of the above-mentioned first thin-film transistor; a third transistor and a fourth transistor, which are connected between the source electrode of the above-mentioned second thin-film transistor and the anode of the above-mentioned electroluminescence device, for being switched in accordance with a predetermined external signal that is applied to respective gate electrodes; and a charging capacitor, which is connected between the above-mentioned third thin-film transistor and fourth thin-film transistor.

The electroluminescence display apparatus for performing display operations by causing the electroluminescence device, which comprises the anode and cathode, to emit light, comprises: the first thin-film transistor, of which the source electrode is connected to the holding capacitor, the drain electrode is connected to the drain signal line, and the gate electrode is connected to the gate signal line; the second thin-film transistor, of which the drain electrode is connected to the driving power supply of the above-mentioned electroluminescence device, and the gate electrode is connected to the source electrode of the above-mentioned first thin-film transistor; a first diode and a second diode, which are connected in series in a forward direction toward the anode of the above-mentioned luminescence device from the above-mentioned second thin-film transistor between the source electrode of the second thin-film transistor and the anode of the electroluminescence device; and a charging capacitor, which is connected between the above-mentioned first diode and the above-mentioned second diode. The driving power supply generates an output, the voltage of which changes periodically.

The electroluminescence display apparatus for performing display operations by causing the electroluminescence device, which comprises the anode and cathode, to emit light, comprises: a first switching device for receiving a display signal in accordance with a selection signal; the holding capacitor, which is connected to the first switching device, for holding the received display signal for a fixed period; a second switching device, which is connected between the holding capacitor and the first switching device, for operating by receiving at a control electrode the display signal voltage that was held by the holding capacitor and for outputting a current from the driving power supply of the above-mentioned electroluminescence device; a third switching device and a fourth switching device, which are disposed in this order between the second switching device and the anode of the electroluminescence device; and a charging capacitor, which is disposed between the third switching device and the fourth switching device, is charged from current that is output from the driving power supply via the second switching device and third switching device by operation of the third switching device. The third switching device is operated so that the charging capacitor is charged up to a voltage corresponding to a display signal voltage that was applied to the control electrode of the second switching device. The fourth switching device is operated so as to drive the electroluminescence device by applying an electric charge that was stored in the charging capacitor to the anode of the electroluminescence device.

The above-mentioned electroluminescence display apparatus has the above-mentioned first and second switching devices and the above-mentioned third and fourth switching devices respectively configured from thin-film transistors. Furthermore, the third and fourth switching devices operate alternately by receiving at respective gate electrodes, which are control electrodes, an external signal, which inverts at a fixed period shorter than a display signal holding period to the holding capacitor.

In another aspect of the present invention, the above-mentioned electroluminescence display apparatus has: the first and second switching devices configured from thin-film transistors, and the third and fourth switching devices configured from diodes connected in series in a forward direction from the second switching device to the anode of the electroluminescence device; the cathode of the electroluminescence device connected to the driving power supply of the electroluminescence device; the driving power supply of the electroluminescence device inverts an output level at a fixed period shorter than the display signal holding period of the holding capacitor; and an output from the driving power supply of the electroluminescence device alternately operate the third switching device and the fourth switching device so as to perform charging and discharging of the charging capacitor.

In the above-mentioned electroluminescence display apparatus: the electroluminescence device is a current-driven device causing an organic light emitting layer, which is sandwiched by the anode and the cathode and where holes are injected from the anode and electrons are injected from the cathode, to emit light.

If the electroluminescence device is driven according to the configurations described above, even with variations present in each second thin-film transistor or in the current characteristics of each second switching device, the charging capacitor can be charged from the driving power supply with a voltage substantially equal to the voltage that is applied to the gate electrode of the operating second thin-film transistor (second switching device). Therefore, the current that is supplied to the electroluminescence device corresponds to the voltage charged to the charging capacitor, namely, the voltage (display signal voltage held in the holding capacitor) that is applied to the gate electrode of the second thin-film transistor (second switching device). For this reason, variations in light emission of the electroluminescence device due to variations in characteristics of the second thin-film transistors are prevented so as to improve the display quality of the display apparatus.

In particular, since current without variations can be supplied to the current-driven organic EL device, it is possible to provide a high-quality organic EL display apparatus.

DETAILED DESCRIPTION OF THE PREFERRED EMBODIMENTS

[First Embodiment]

A drive circuit of the EL display apparatus according to the present invention will be described hereinafter.

Figure 1:
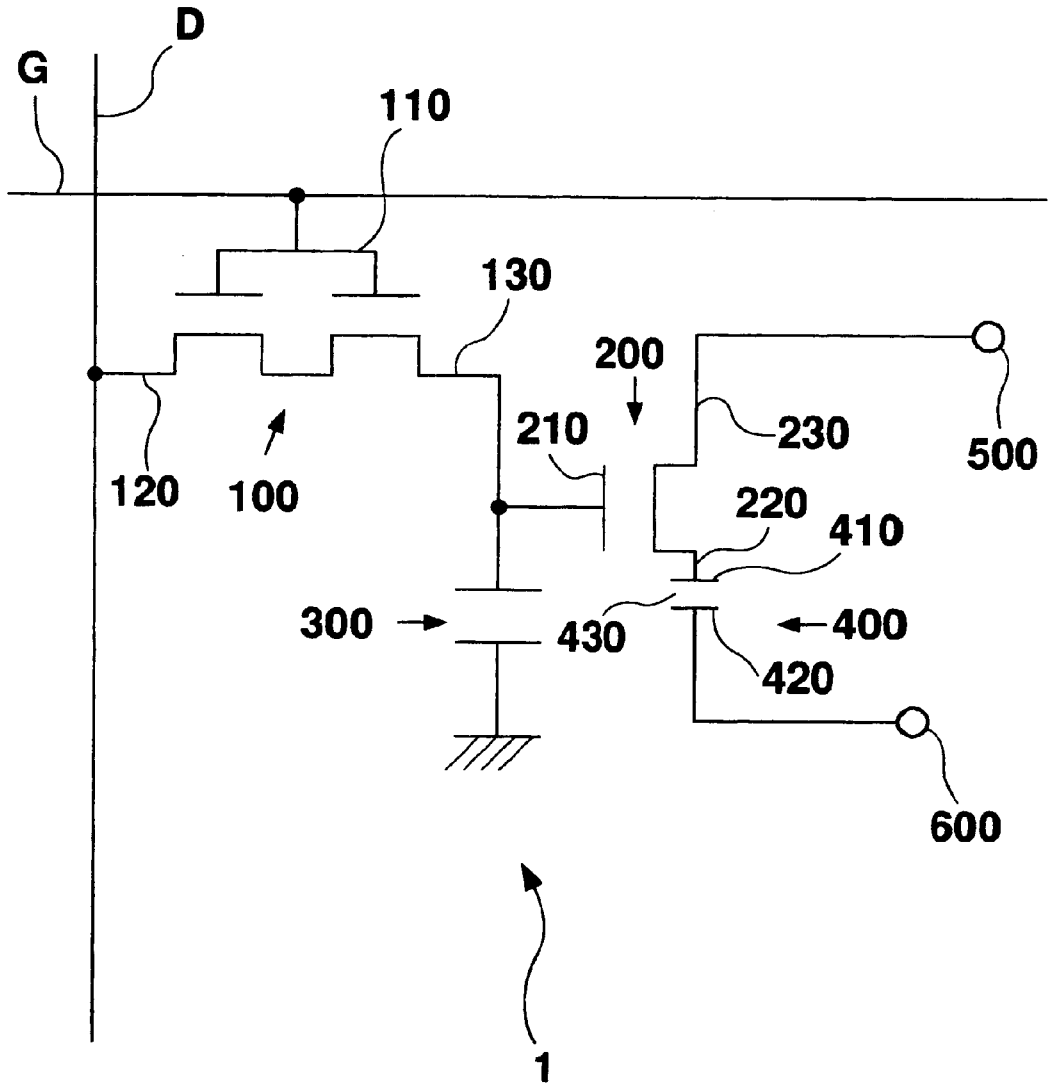
Fig. 1 PRIOR ART
FIG. 1 is a circuit diagram of an EL display apparatus of the prior art.
Figure 2:
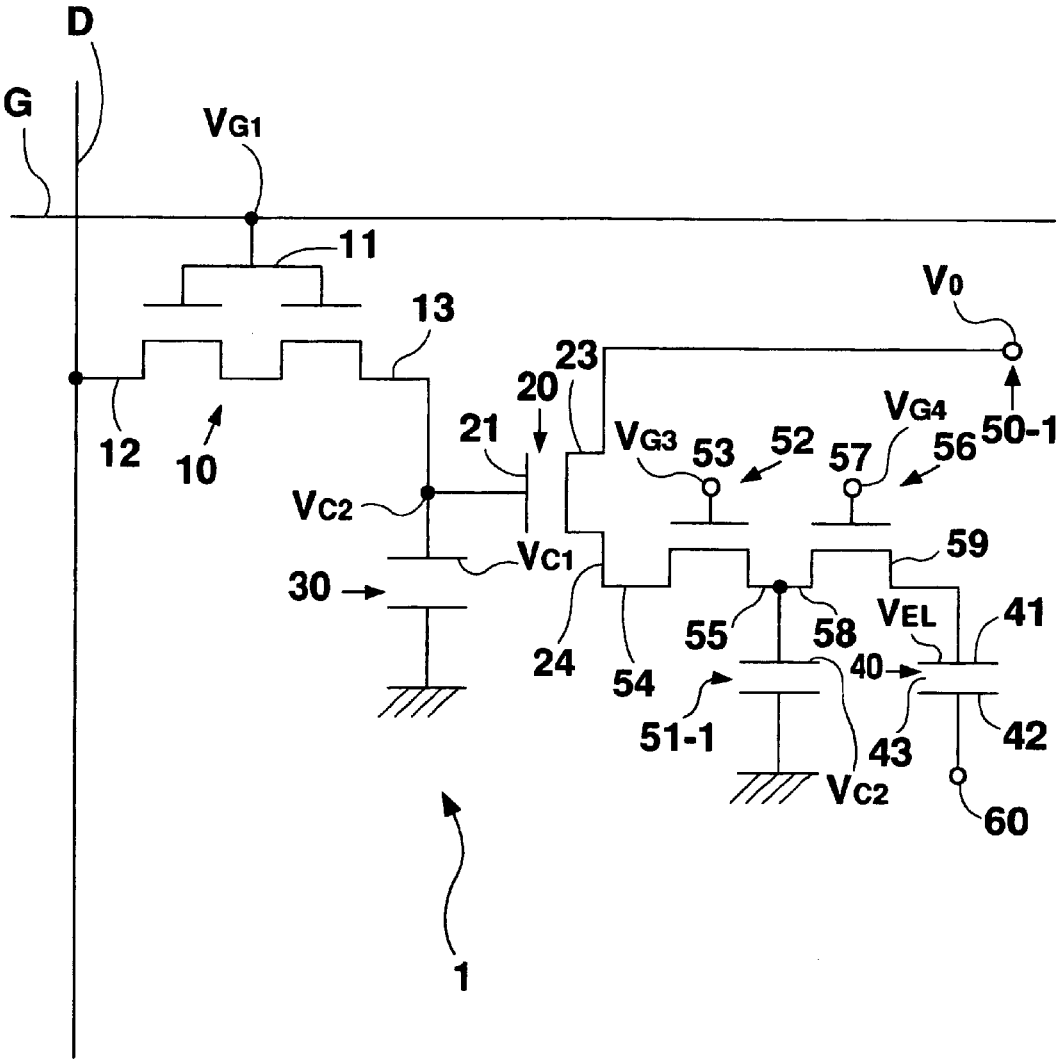
FIG. 2 is a circuit diagram of the EL display apparatus showing the first embodiment of the present invention.

FIG. 2 is a circuit diagram of one display pixel in the EL display apparatus of this embodiment comprising the organic EL device and TFTs. Signal waveform diagrams are respectively shown of a signal $V_{G1}$ that is supplied to the gate electrode of the first TFT in FIG. 3(*a*), of a signal $V_{G2}$ that is supplied to the gate electrode of the second TFT in FIG. 3(*b*), of a signal $V_0$ of the driving power supply in FIG. 3(*c*), of a signal $V_{G3}$ that is supplied to the gate electrode of the third TFT in FIG. 3(*d*), of a signal $V_{G4}$ that is supplied to the gate electrode of the fourth TFT in FIG. 3(*e*), of a signal $V_{C2}$ that is stored in a charging capacitor in FIG. 3(*f*), and of a signal $V_{EL}$ for light emission of the organic EL device in FIG. 5(*g*).

The drive circuit for the EL device in the EL display apparatus of this embodiment comprises a first TFT 10, which is a first switching device, a second TFT 20, a holding capacitor 30, an organic EL device 40, a driving power supply 50-1, a third TFT 52, a fourth TFT 56, and a charging capacitor 51-1.

As shown in FIG. 2, a first TFT 10 and the holding capacitor 30 have a circuit configuration (first TFT 100 and holding capacitor 300) and drive method that are identical to those in the above-mentioned prior art.

A gate electrode 21 of the second TFT 20 is connected to a source electrode 13 of the first TFT 10 and one electrode of the holding capacitor 30, and a drain electrode 23 of the second TFT 20 is connected to the driving power supply 50-1 for the organic EL device 40. A source electrode 24 of the second TFT 20 is connected to a drain electrode 54 of the third TFT 52.

Gate electrodes 53, 57 of the third and fourth TFTs 52, 56 are respectively supplied with periodic signals $V_{G3}$ and $V_{G4}$ from an external source. The signals $V_{G3}$ and $V_{G4}$ have phases opposite to each other. A source electrode 55 of the third TFT 52 and a drain electrode 58 of the fourth TFT 56 are connected together. The charging capacitor 51-1 is connected to a point between the third and fourth TFTs 52, 56. A source electrode 59 of the fourth TFT 56 is connected to an anode 41 of the organic EL device 40 and a cathode 42, which is a common electrode, of the organic EL device 40 is connected to a common power supply terminal 60. It should be noted that the anode 41 of the above-mentioned organic EL device 40 is, for example, an ITO transparent electrode and also used as a display electrode.

A plurality of the display pixel 1 formed from the organic EL device and TFTs configured in this manner are arranged in a matrix to form a display panel of the EL display apparatus.

Next, the drive method of the EL display apparatus of the present invention will be described with reference to FIGS. 2 and 3.

Figure 3:
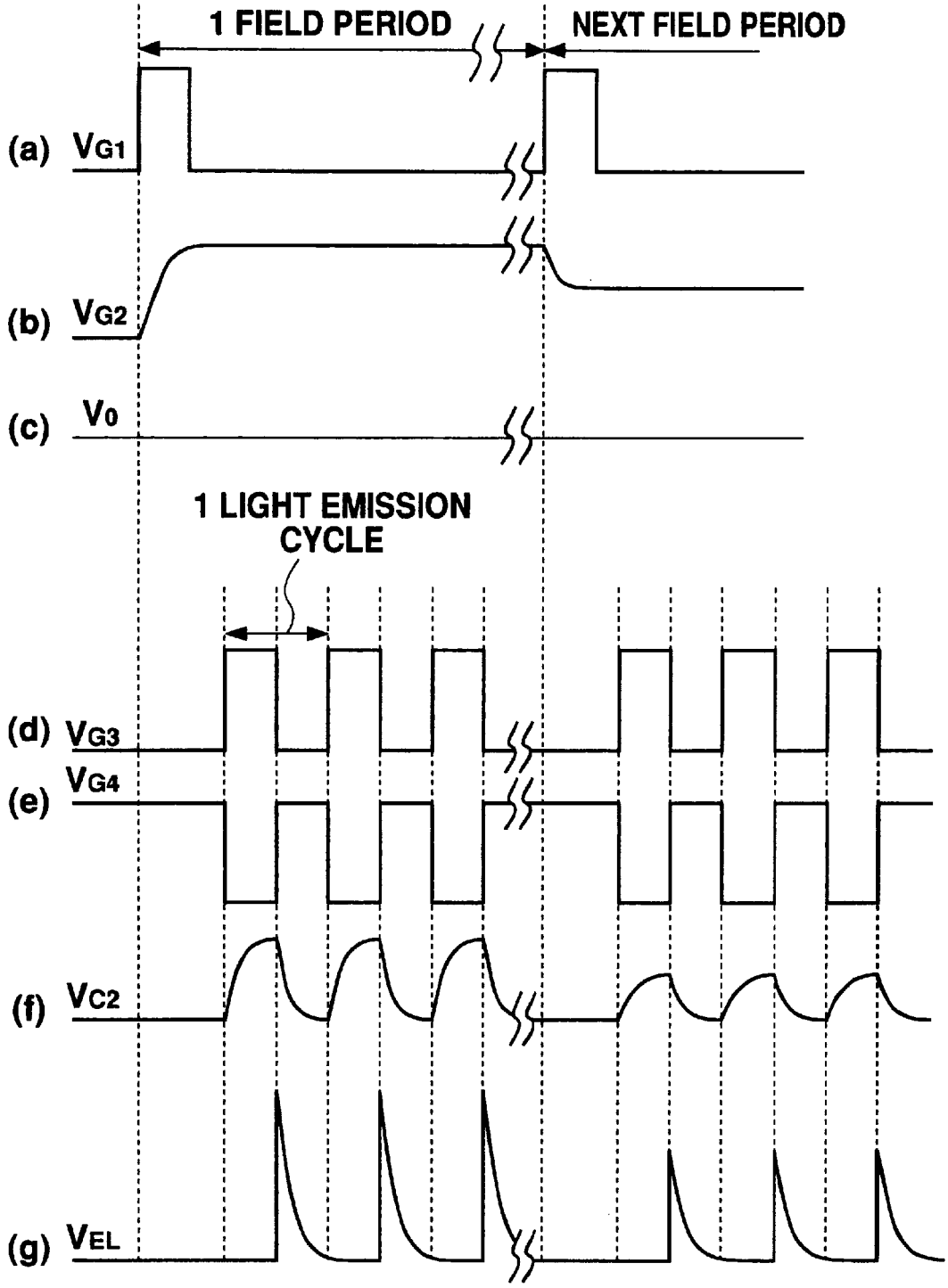
FIG. 3 is a signal waveform diagram showing the first embodiment of the present invention.

The gate signal $V_{G1}$ of the gate signal line G is supplied as a selection signal to a gate electrode 11 of the first TFT 10 as shown in FIG. 3(*a*) so that the first TFT 10 turns on. The drain signal from the drain signal line D is then supplied as a display signal to the gate electrode 21 of the second TFT 20 and the holding capacitor 30. As shown in FIG. 3(*b*), $V_{G2}$ is applied to the second TFT 20 and the ON state is maintained for one field period. (At this time, an electrode potential $V_{C1}$ at the other end of the holding capacitor 30 has the same electrical potential as $V_{G2}$.)

As a result, the driving power supply 50-1 (electric potential $V_0$) causes a voltage in response to the voltage $V_{G2}$ at the gate electrode 21 to be supplied to the drain electrode 54 of the third TFT 52.

At this time, the signal voltages $V_{G3}$, $V_{G4}$ shown in FIGS. 3(*d*) and 3(*e*) are respectively supplied to the gate electrodes 53, 57 of the third and fourth TFTs 52, 56. As shown in these same figures, signals $V_{G3}$ and $V_{G4}$ have phases opposite to each other so that the third and fourth TFTs 52, 56 turn on alternately.

Namely, a voltage $V_{C2}$ of the charging capacitor 51-1 is charged, as shown in FIG. 3(*f*), when the signal $V_{G3}$ is an ON signal and the signal $V_{G4}$ is an OFF signal, and discharged when the signal $V_{G3}$ is an OFF signal and the signal $V_{G4}$ is an ON signal. In this manner, signals $V_{G3}$ and $V_{G4}$ cause the charging and discharging (one light emission cycle) to repeat for the charging capacitor 51-1.

Therefore, since the fourth TFT 56 is off when the third TFT 52 turns on, the charge of the driving power supply 50-1 that is supplied to the drain electrode 54 of the third TFT 52 via the second TFT 20 is stored in the charging capacitor 51-1.

Furthermore, since the fourth TFT 56 is on when the third TFT 52 turns off, the electric charge that is stored in the charging capacitor 51-1 is discharged.

In this manner, the electric charge that is stored in the charging capacitor 51-1 when the third TFT 52 is on is supplied to the anode 41 of the organic EL device 40 via the drain electrode 58 and the source electrode 59 of the fourth TFT 56 when the third TFT 52 turns off and the fourth TFT 56 turns on. As a result, the organic EL device 40 emits light at every light emission cycle in response to the voltage $V_{C2}$ as shown by $V_{EL}$ in FIG. 3 (*g*).

The supply of a stable current to the organic EL device even if the characteristics of the second TFT in each display pixel varies will now be described.

First, it is assumed that in the TFT the currents flowing to the drain when a certain gate voltage is applied are denoted by Ida and Idb (Ida>Idb), respectively, for second TFTa and TFTb having differing current characteristics.

When a conventional drive circuit for the EL display apparatus is used with TFTa and TFTb having different current characteristics, the TFTa (Ida) having good current characteristics can supply a large current to the organic EL device so that the intensity of the light emission from the organic EL device connected to the TFTa is high, whereas the TFTb (Idb) having poor current characteristics cannot supply a large current to the organic EL device like the TFTa so that the intensity of the light emission from the organic EL device connected to the TFTb is lower than that of the organic EL device connected to the TFTa. Therefore, between the display pixels, which are ideally designed to have identical light emission intensities, variations may occur in the brightness of the respective organic EL devices connected to the TFTa and TFTb.

However, according to the drive circuit of the EL display apparatus of the present invention, when the second TFT 20 and the third TFT 30 in FIG. 2 turn on, the charging capacitor 51-1 is charged ($V_{G2}$=$V_{C2}$) up to the voltage $V_{G2}$, which was applied to the gate of the second TFT 20. Since a current in accordance with the charged voltage is supplied to the organic EL device, the same current is supplied to the organic EL device even with TFTs having different current characteristics, such as the second TFTa and TFTb described above. In other words, even if there are differences in current characteristics of the TFTs, the voltages of the fully charged charging capacitors are identical although with differing charging times.

Therefore, since the current that is supplied to the organic EL device is in accordance with the voltage that was charged to the charging capacitor, currents having the same values flow to the organic EL devices even though the current characteristics of the second TFTS may vary.

Namely, even with variations in the characteristics of the second TFTs, the same current can be supplied to the organic EL devices of the display pixels regardless of the characteristics so that the light emissions of the current-driven organic EL devices are equal and a display with uniform brightness can be obtained.

The ON-OFF repetition resulting from the signals that are supplied from external sources to the third and fourth TFTS, namely, one light emission cycle of the organic EL device of one field period may be set, such as to 10 kHz, in accordance with the time it takes for the voltage of the charging capacitor 51-1 to reach the fully charged voltage.

[Second Embodiment]

The second embodiment of the drive circuit for the EL display apparatus according to the present invention will be described hereinafter.

Figure 4:
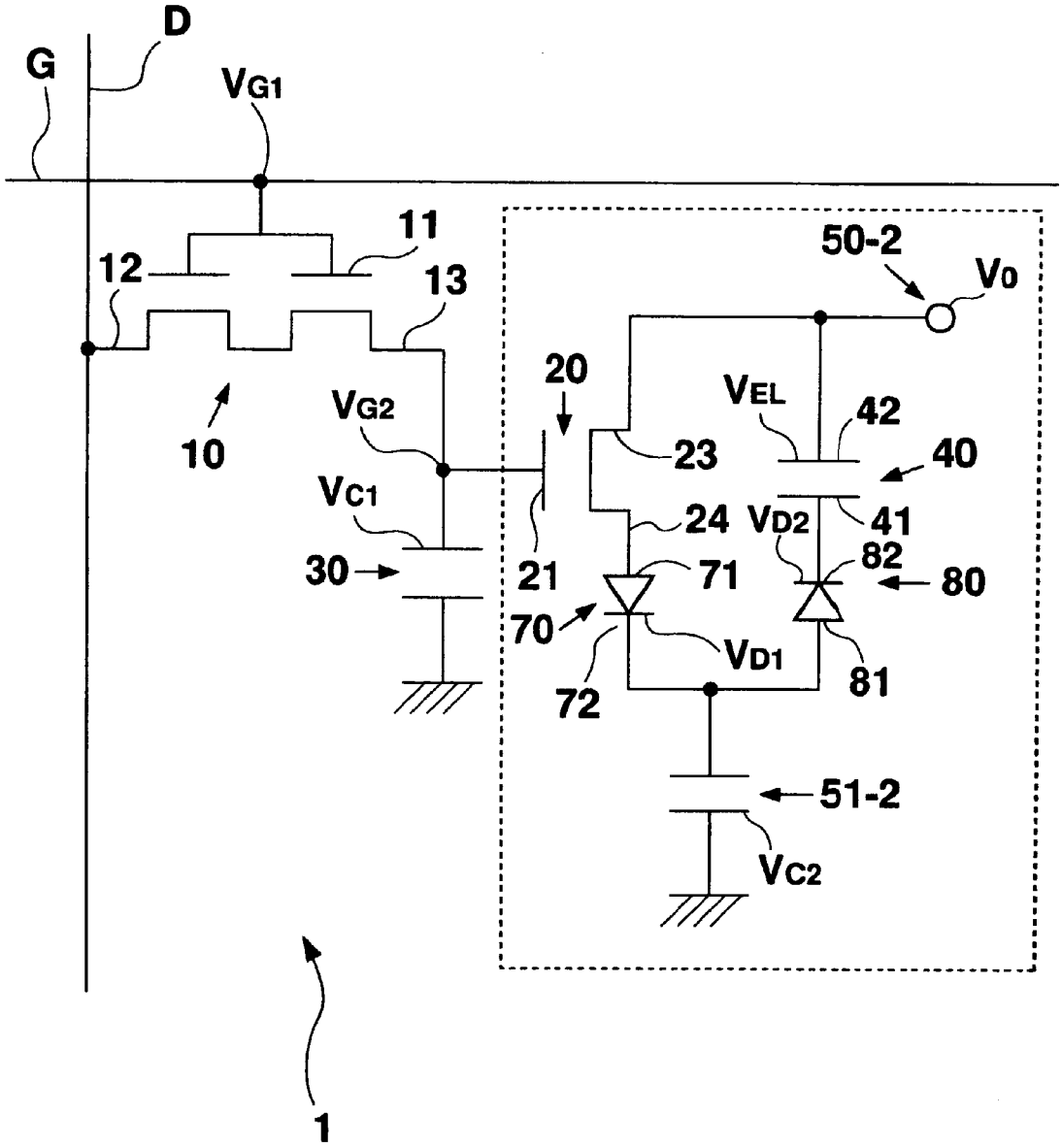
FIG. 4 is a circuit diagram of the EL display apparatus showing the second embodiment of the present invention.
Figure 5:
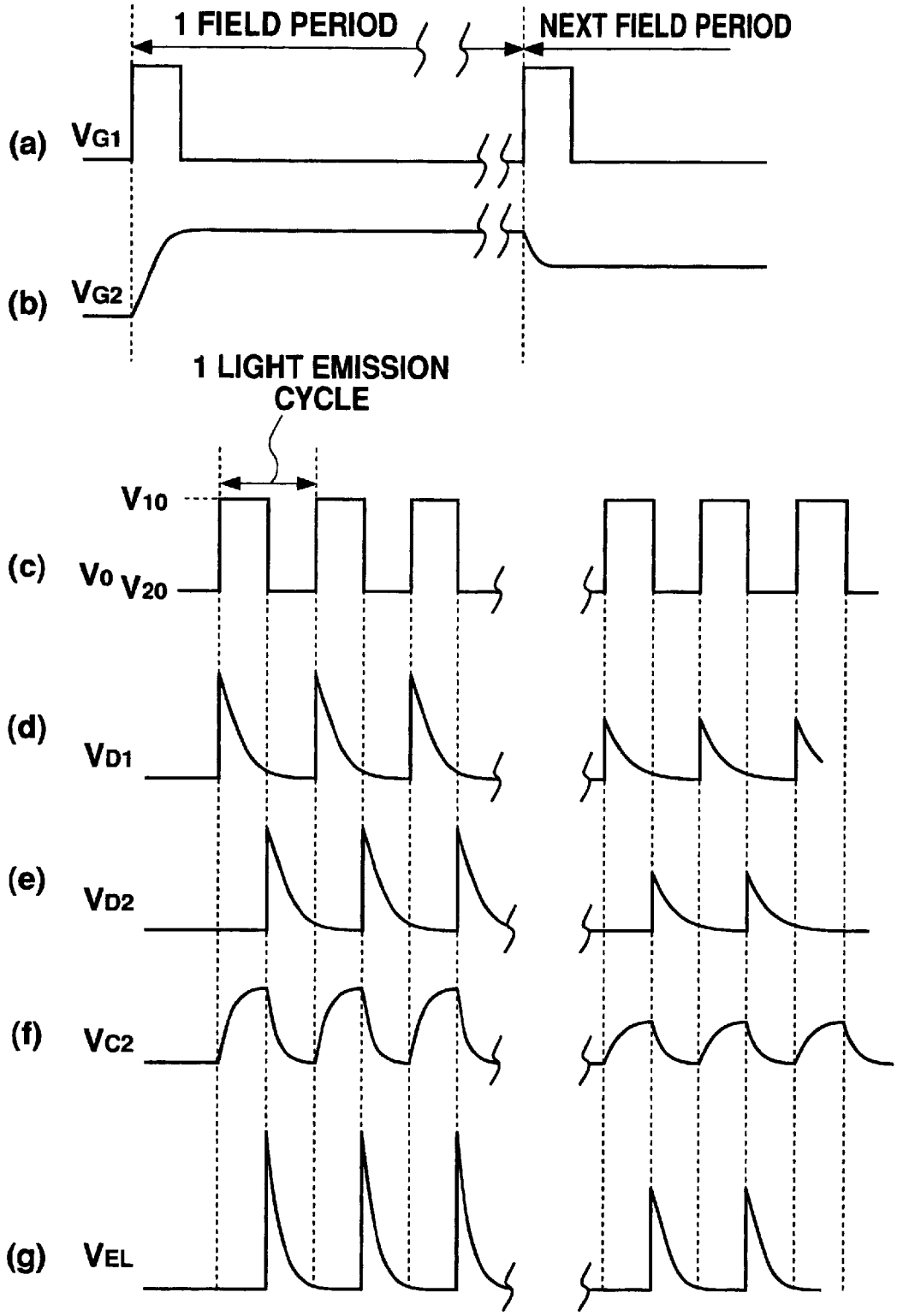
FIG. 5 is a signal waveform diagram showing the second embodiment of the present invention.

FIG. 4 is a circuit diagram of the second embodiment of the present invention and FIG. 5 is a signal waveform diagram of various signals. Signal waveform diagrams are respectively shown of the signal $V_{G1}$ that is supplied to the gate electrode of the first TFT in FIG. 5(*a*), of the signal $V_{G2}$ that is supplied to the gate electrode of the second TFT in FIG. 5(*b*), of the signal $V_0$ of the driving power supply in FIG. 5(*c*), of a signal current $V_{D1}$ that flows to a first diode in FIG. 5(*d*), of a signal current $V_{D2}$ that flows to a second diode in FIG. 5(*e*), of the signal $V_{C2}$ that is stored in the charging capacitor in FIG. 5(*f*), and of the signal $V_{EL}$ of light emission of the organic EL device in FIG. 5(*g*).

As shown in FIG. 4, the first TFT 10 and the holding capacitor 30 have the same circuit configuration and drive method as in the first embodiment.

The gate electrode 21 of the second TFT 20 is connected to the source electrode 13 of the first TFT 10 and to one end of the holding capacitor 30, and the drain electrode 23 of the second TFT 20 is connected to a driving power supply 50-2 of the organic EL device 40. The source electrode 24 is connected to an anode 71 of a first diode 70.

A cathode 72 of the first diode 70 and an anode 81 of a second diode 80 are connected in series. One electrode of a charging capacitor 51-2 is connected to a point between the first and second diodes 70, 80. Another electrode of the charging capacitor 51-2 is connected to ground.

A cathode 82 of the second diode 80 is connected to the anode 41 of the organic EL device 40.

The cathode 42 of the organic EL device 40 is connected to the driving power supply 50-2.

A plurality of the display pixel 1 configured in this manner are arranged in a matrix to form the organic EL display apparatus.

A voltage supplied by the driving power supply 50-2 is described herein with reference to FIGS. 4 and 5.

The gate signal $V_{G1}$ of the gate signal line G as shown in FIG. 5(*a*) is supplied to the electrode 11 of the first TFT 10 so that the first TFT 10 turns on. As a result, the drain signal from the drain signal line D is supplied to the gate electrode 21 of the second TFT 20 and to the holding capacitor 30, and $V_{G2}$ is applied to the second TFT 20 as shown in FIG. 5(*b*) so that the ON state is maintained for one field period. (At this time, the electrode potential $V_{C1}$ at the other end of the holding capacitor 30 has the same electric potential as $V_{G2}$.)

The driving power supply 50-2 alternately supplies a charging voltage $V_{10}$ and a discharging voltage $V_{20}$ at a predetermined frequency as shown in FIG. 5(*c*), such as a frequency of 10 kHz, so that the organic EL device 40 emits light.

At this time, the charging voltage $V_{10}$ has a higher voltage than the voltage being charged to a charging capacitor 51-2, and the discharging voltage $V_{20}$ has a voltage lower than the voltage being charged to the charging capacitor 51-2.

Namely, when the voltage of the driving power supply 50-2 is the charging voltage $V_{10}$, current flows in the direction of the first diode 70 (FIG. 5(*d*)) to charge the charging capacitor 51-2 (FIG. 5(*f*)), and when the voltage of the driving power supply 50-2 is the discharging voltage $V_{20}$, current flows in the forward direction of the second diode 80 (FIG. 5(*e*)) to discharge the holding capacitor 51-2 (FIG. 5(*f*)) and to supply the organic EL device 40 for light emission (FIG. 5(*g*)).

At this time, when current flows in the forward direction of the first diode 70, current does not flow in the forward direction of the other diode 80, and when current flows in the forward direction of the second diode 80, current does not flow in the forward direction of the other diode 70.

Therefore, alternately supplying the charging voltage $V_{10}$ and the discharging voltage $V_{20}$ from the driving power supply 50-2 at a predetermined period causes the holding capacitor 51-2 to repeat the charge-discharge cycle at that period.

The drive method until the emission of light by the voltage of the driving power supply 50-2 being supplied to the organic EL device 40 is described with particular attention to an equivalent circuit of the area enclosed in the dotted lines.

In the period where the second TFT 20 turns on (FIG. 5(*b*)) and the charging voltage $V_{10}$ is supplied from the driving power supply 50-2, a voltage is charged in accordance with the gate voltage $V_{G2}$ (FIG. 5(*b*)) of the second TFT 20 to the charging capacitor 51-2 via the first diode 70. Thereafter, when the driving power supply 50-2 switches to the discharging voltage $V_{20}$, the electric charge that was charged in the charging capacitor 51-2 is supplied to the organic EL device 40 for light emission via the second diode 80.

This operation is repeated, such as at the frequency of 10 kHz mentioned above, during the period in which the drain signal that was written to the holding capacitor 30 is held, namely, during one field.

In this manner, during the period in which the drain signal is written once and held in the holding capacitor 30, the repeated supply of the charging voltage $V_{10}$ and the discharging voltage $V_{20}$ at a fixed period from the driving power supply 50-2 causes charging and discharging of electric charge in the charging capacitor 51-2 to repeat.

Therefore, as described for the first embodiment, the current that is supplied to the organic EL device is in accordance with the voltage charged to the charging capacitor 51-2, namely, the voltage $V_{G2}$ of the gate electrode of the second TFT, so that a stable current is supplied to the organic EL device even though the current characteristics of the second TFTs of the display pixels may vary. This can yield an EL display having uniform light emission among the display pixels.

The supply cycle of charging voltage and discharging voltage, namely, one light emission cycle of the organic EL device is preferably set, such as to 10 kHz, in accordance with the time it takes for the voltage of the charging capacitor 51-2 to reach the fully charge voltage.

Furthermore, in this embodiment, the signal lines for supplying signals from an external source to switch the ON-OFF states of the third and fourth TFTs according to the first embodiment can also be omitted, and as a result can improve the aperture ratio of the display apparatus.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. An electroluminescence display apparatus for performing display operations by an electroluminescence device, which comprises an anode and a cathode, emitting light, comprising:

a first thin-film transistor, having a source electrode connected to a holding capacitor, a drain electrode connected to a drain signal line, and a gate electrode connected to a gate signal line;

a second thin-film transistor, having a drain electrode connected to a driving power supply of said electroluminescence device, and a gate electrode connected to the source electrode of said first thin-film transistor;

a third transistor and a fourth transistor, connected between the source electrode of said second thin-film transistor and said anode of said electroluminescence device, for being switched in accordance with a predetermined external signal that is applied to respective gate electrodes; and a charging capacitor, which is connected between said third thin-film transistor and fourth thin-film transistor.

2. The electroluminescence display apparatus according to claim 1 wherein:

said third thin-film transistor and fourth thin-film transistor are controlled by said external signal so as to alternately switch ON and OFF.

3. The electroluminescence display apparatus according to claim 1 wherein:

said electroluminescence device is a current-driven device causing an organic light emitting layer, which is sandwiched by said anode and said cathode and where holes are injected from said anode and electrons are injected from said cathode, to emit light.

4. An electroluminescence display apparatus for performing display operations by causing the electroluminescence device, which comprises the anode and cathode, to emit light, comprising:

a first switching device for receiving a display signal in accordance with a selection signal;

a holding capacitor, connected to said first switching device, for holding the received display signal for a fixed period;

a second switching device, connected between said holding capacitor and said first switching device, for operating by receiving in a control electrode a display signal voltage that was held by said holding capacitor and for outputting a current from the driving power supply of said electroluminescence device;

a third switching device and a fourth switching device, disposed in this order between said second switching device and the anode of said electroluminescence device; and a charging capacitor, disposed between said third switching device and said fourth switching device, for charging from current that is output from said driving power supply via the second switching device and third switching device by operation of said third switching device;

said third switching device being operated so that said charging capacitor is charged up to a voltage corresponding to the display signal voltage that was applied to the control electrode of said second switching device;

said fourth switching device being operated so as to drive said electroluminescence device by applying an electric charge that was charged in said charging capacitor to the anode of said electroluminescence device.

5. The electroluminescence display apparatus according to claim 4 wherein:

said first and second switching devices and said third and fourth switching devices are respectively configured from thin-film transistors.

6. The electroluminescence display apparatus according to claim 5 wherein:

said third and fourth switching devices operate alternately by receiving at respective gate electrodes, being control electrodes, the external signal, which inverts at a fixed period shorter than a display signal holding period of said holding capacitor.

7. The electroluminescence display apparatus according to claim 4 wherein:

said first and second switching devices are configured from thin-film transistors, and said third and fourth switching devices are configured from diodes connected in series in a forward direction from said second switching device to the anode of said electroluminescence device;

the cathode of said electroluminescence device is connected to the driving power supply of said electroluminescence device;

the driving power supply of said electroluminescence device inverts an output level at a fixed period shorter than the display signal holding period of said holding capacitor; and the output from the driving power supply of said electroluminescence device alternately operates said third switching device and said fourth switching device so as to perform charging and discharging of said charging capacitor.

8. The electroluminescence display apparatus according to claim 4 wherein:

said electroluminescence device is a current-driven device causing an organic light emitting layer, which is sandwiched by said anode and said cathode and where holes are injected from said anode and electrons are injected from said cathode, to emit light.

* * * * *

UNITED STATES PATENT AND TRADEMARK OFFICE

CERTIFICATE OF CORRECTION

PATENT NO. : 6,246,384 B1
DATED : June 12, 2001
INVENTOR(S) : Keiichi Sano

It is certified that error appears in the above-identified patent and that said Letters Patent is hereby corrected as shown below:

Column 1,
Line 64, after "from" delete "4,4'-bis(3-methylphenylphenylamino)biphenly" and insert therefor -- 4,4',4"-tris(3-methylphenylphenylamino)triphenylamine --
Line 66, delete "4,4',4"-tris(3-methylphenylphenylamino)triphenylanine" and insert therefor -- N,N'-diphenyl-N,N'-di(3-methylphenyl)-1,1'-biphenyl-4,4'-diamine --
Line 67, after "from" delete "10-benzo[h]beryllium-benzoquinolinol" and insert therefore -- bis(10-hydroxybenzo[h]quinolinato)beryllium --

Signed and Sealed this

Twenty-second Day of February, 2005

JON W. DUDAS
*Director of the United States Patent and Trademark Office*